US009181720B2

(12) United States Patent
Barnett

(10) Patent No.: US 9,181,720 B2
(45) Date of Patent: Nov. 10, 2015

(54) ANTI-EVISCERATION RING

(71) Applicant: Ralph L. Barnett, Wilmette, IL (US)

(72) Inventor: Ralph L. Barnett, Wilmette, IL (US)

(73) Assignee: Triodyne Safety Systems, L.L.C., Glenview, IL (US)

( * ) Notice: Subject to any disclaimer, the term of this patent is extended or adjusted under 35 U.S.C. 154(b) by 195 days.

(21) Appl. No.: 13/665,657

(22) Filed: Oct. 31, 2012

(65) Prior Publication Data

US 2013/0125302 A1 May 23, 2013

Related U.S. Application Data

(60) Provisional application No. 61/553,354, filed on Oct. 31, 2011.

(51) Int. Cl.

| | |
|---|---|
| ***E04H 4/00*** | (2006.01) |
| ***E04H 4/06*** | (2006.01) |
| ***E04H 4/12*** | (2006.01) |

(52) U.S. Cl.

CPC ..... *E04H 4/06* (2013.01); *E04H 4/1236* (2013.01)

(58) Field of Classification Search

CPC ..... E04H 4/06
USPC ..... 4/504, 507, 509
See application file for complete search history.

(56) References Cited

U.S. PATENT DOCUMENTS

| | | | |
|---|---|---|---|
| 3,239,149 | A | 3/1966 | Lindberg, Jr. |
| 3,497,878 | A | 3/1970 | Emery |
| 3,523,552 | A | 8/1970 | Ogden |
| 3,616,916 | A | 11/1971 | Greene |
| 3,620,372 | A | 11/1971 | Gordon |
| 4,485,011 | A | 11/1984 | Cole et al. |
| 4,490,067 | A | 12/1984 | Dahowski |
| 4,742,593 | A | 5/1988 | Kallenbach |
| 4,912,782 | A | 4/1990 | Robbins |
| 4,973,403 | A | 11/1990 | Kozey |
| 5,040,250 | A | 8/1991 | Barnes et al. |
| 5,341,523 | A | 8/1994 | Barnes |
| 5,454,940 | A | 10/1995 | Lakotish |
| 5,536,397 | A | 7/1996 | D'Offay |
| 5,665,248 | A | 9/1997 | McKiddy, II |
| 5,734,999 | A | 4/1998 | Nicholas |
| 5,771,941 | A | 6/1998 | Almeida |

(Continued)

FOREIGN PATENT DOCUMENTS

| | | |
|---|---|---|
| DE | 3106822 A1 | 10/1982 |
| EP | 0677622 | 10/1995 |
| GB | 2297110 | 7/1996 |

OTHER PUBLICATIONS

"American National Standard for Suction Entrapment Avoidance in Swimming Pools, Wading Pools, Spas, Hot Tubs, and Catch Basins", ANSI/APSP-7, 2006.

(Continued)

*Primary Examiner* — Huyen Le
*Assistant Examiner* — Christine Skubinna
(74) *Attorney, Agent, or Firm* — Pauley Erickson & Kottis

(57) ABSTRACT

Missing and broken drain covers for swimming pools, spas and/or other applications expose swimmers to dangers including entrapment and evisceration. An anti-evisceration ring of this invention is attached to an opening of a sump or frame and provides a non-planar edge that prevents the formation of a vacuum by a body part and thereby preventing injuries to swimmers.

19 Claims, 8 Drawing Sheets

(56) References Cited

U.S. PATENT DOCUMENTS

| | | | | |
|---|---|---|---|---|
| 5,809,587 | A | 9/1998 | Fleischer | |
| 5,894,609 | A | 4/1999 | Barnett | |
| D410,073 | S | 5/1999 | Barnett | |
| 5,978,981 | A | 11/1999 | Nelson | |
| 6,009,573 | A | 1/2000 | Thibault | |
| D421,101 | S | 2/2000 | Barnett | |
| D421,102 | S * | 2/2000 | Barnett | D23/261 |
| D421,295 | S * | 2/2000 | Barnett | D23/261 |
| 6,088,842 | A | 7/2000 | Barnett | |
| 6,170,095 | B1 | 1/2001 | Zars | |
| D439,957 | S | 4/2001 | Barnett et al. | |
| 6,230,337 | B1 | 5/2001 | Barnett | |
| 6,295,661 | B1 | 10/2001 | Bromley | |
| 6,561,391 | B1 | 5/2003 | Baker | |
| 6,578,208 | B1 | 6/2003 | Lytle | |
| 6,738,994 | B2 | 5/2004 | Barnett et al. | |
| 6,817,043 | B2 * | 11/2004 | Zars | 4/504 |
| 2013/0117924 | A1 | 5/2013 | Barnett | |

OTHER PUBLICATIONS

"Guidelines for Entrapment Hazards: Making Pools and Spas Safer", U.S. Consumer Product Safety Commission, Mar. 2005, Washington, D.C.

Velasco, Maria Valeria Robles et al., "Hair Fiber Characteristics and Methods to evaluate Hair Physical and Mechanical Properties", Brazilian Jnl of Pharmaceutical Sciences, v. 45, No. 1. pp. 153-162, Jan.-Mar. 2009.

"Unexpected Properties of Hair", LorealHairScience.com, http://www.hair-science.com/__int/__en/topic/topic__sousrub.aspx?tc=root-hair-scienceso-sturdy-so-fragileproperties-of-hair&cur=properties-of-hair.

"Hair Strength", www.keratin.com, http://www.keratin.com/aa/aa016.shtml.

"American National Standard for Suction Fittings for Use in Swimming Pools, Wading Pools, Spas and Hot Tubs", ANSI/APSP-16, 2011.

Barnett, Ralph L., "Anti-Hair Entanglement", Triodyne Inc. Safety Alert, vol. 1, No. 1, Feb. 1998.

Barnett, Ralph L. et al., "Anti-Hair Snare Pool Drain Cover", Triodyne Inc. Safety Brief, vol. 18, No. 4, May 2001.

New York Codes, Rules and Regulations, 6-1.29, Section 9.6.2, Swimming Pool Design Standards, 2007.

Virginia Graeme Baker Pool and Spa Safety Act, 15 U.S.C. 8001.

"Suction Fittings for Use in Swimming Pools, Wading Pools, Spas and Hot Tubs", ASME A112.19-8-2007, 2007.

"Code of Practice for Swimming Pools: Metric Units", New Zealand Standards, NZS 4441: 1985.

Woodruff, John, "Improving the Strength of Hair", Cosmetics and Toiletries Magazine, 2002.

"VGB Series Submerged, Multiple and Single Suction Outlet Instructions", AquaStar, Rev. 031813, www.aquastarpoolproducts.com.

* cited by examiner

ANTI-EVISCERATION RING

CROSS REFERENCE TO RELATED APPLICATION

This application claims the benefit of U.S. Provisional Patent Application, Ser. No. 61/553,354, filed on 31 Oct. 2011. The Provisional Patent Application is hereby incorporated by reference herein in its entirety and is made a part hereof, including but not limited to those portions which specifically appear hereinafter.

BACKGROUND OF THE INVENTION

1. Field of the Invention

This invention is directed to a safety ring that provides a non-planar periphery around a drain hole that cannot be sealed against water or gas flow by a body part.

2. Discussion of Related Art

This invention relates to drain constructions located in the bottom or along the sides of a pool or hot tub through which water flows under the action of gravity or a pump that acts to suck water out of the pool.

The dangers inherent in pools and hot tubs having circulating water systems are well known and documented. For example, suction or vacuum forces frequently occur near the water drains sufficient to eviscerate and/or hold a swimmer or user fast in life threatening situations. Similarly, the entanglement or knotting of hair on or through a sump, suction line or a drain grate causes serious problems.

Domed suction entrapment covers or grates are generally mounted on cylindrical sumps, frames or mud rings that are permanently installed in the bottoms or sidewalls of swimming pools and spas. These covers constitute a first-line-of-defense against the dangers of evisceration or drowning. To prevent disembowelment, the pool and spa industry strives to maintain convex covers in situ. Anti-vortex covers are effective for preventing evisceration; flat covers are problematic.

However, as shown in FIGS. 1*a* & 1*b*, when the cover or grate is removed from a circular sump 1 or a mud ring 2, a swimmer can seal 3 the circular opening 1, 2 with a body part 4 such as a buttock, back or another body part. The seal 3 may allow a vacuum to form due to an outflow 5, 6 from the drain which may eviscerate or trap the swimmer of a pool or spa. Evisceration injuries are almost always associated with 6" to 8" diameter sumps with broken or missing covers. In normal pools and spas, the pumps may develop sufficient vacuum levels to eviscerate children in less than a quarter second.

A known method of dealing with the concern described above is a safety vacuum release systems (SVRS). However, known SVRS systems are not fast enough to reliably prevent evisceration. Current codes, standards and guidelines will not accept SVRS devices as anti-evisceration devices.

Accordingly there is a need for a protection device that prevents injuries that may be caused by broken or missing pool drain covers.

SUMMARY OF THE INVENTION

A general object of the invention is to provide an anti-evisceration ring with a non-planar edge that can be affixed to a sump or a frame, also known as a mud ring, in swimming pools and spas to prevent injuries that can be caused by missing or broken drain covers. The general object of the invention can be attained, at least in part, through a scalloped or castellated periphery extending around the anti-evisceration ring preventing the formation of a seal around the sump or the frame thereby preventing the formation of a vacuum at the sump or frame opening that could result in a drowning or disembowelment.

The anti-evisceration ring preferably comprises a shape that corresponds to a shape of an opening of a sump or frame. In general, the anti-evisceration ring comprises an annular shape that matches the cylindrical shape of the sump or frame opening. However, the anti-evisceration ring may comprise any shape corresponding to the sump or frame opening, including, but not limited to, a rectangular shape, square shape and a triangular shape.

In a preferred embodiment, the anti-evisceration ring includes a base with a base surface that can be affixed to an opening of the cylindrical sump with a permanent connection, such as an adhesive or a weld. However, the anti-evisceration ring need not be permanently affixed to the sump and may be attached with a removable connection, such as a threaded fastener. In another alternative, the anti-evisceration ring may be integrally formed with the sump or frame.

The anti-evisceration ring of this invention includes a non-planar edge that prevents the formation of a seal at the sump or frame opening. In a preferred embodiment, the non-planar edge comprises a plurality of merlons extending from the base surface with a plurality of crenels positioned between the merlons in a castellation pattern. The plurality of merlons and the plurality of crenels may range from two to hundreds and preferably ranges from eight to sixteen. The castellation pattern significantly decreases the possibility of a body part forming a complete seal around the sump or frame opening thereby preventing injury, by drowning or evisceration, to a person enjoying the swimming pool or spa. In an embodiment of this invention, the crenels may comprise a closed groove design. Alternatively, the crenels may comprise an open groove design. Selection of the closed groove or open groove is largely dependent on the type of pool drain cover used with the anti-evisceration ring.

The anti-evisceration ring of this invention may also include additional safety devices such as anti-hair entrapment devices.

BRIEF DESCRIPTION OF THE DRAWINGS

These and other objects and features of this invention will be better understood from the following detailed description taken in conjunction with the drawings, wherein.

DETAILED DESCRIPTION OF THE INVENTION

The present invention provides a safety ring that prevents injuries due to missing or broken pool frame drain covers.

Figure 1B:
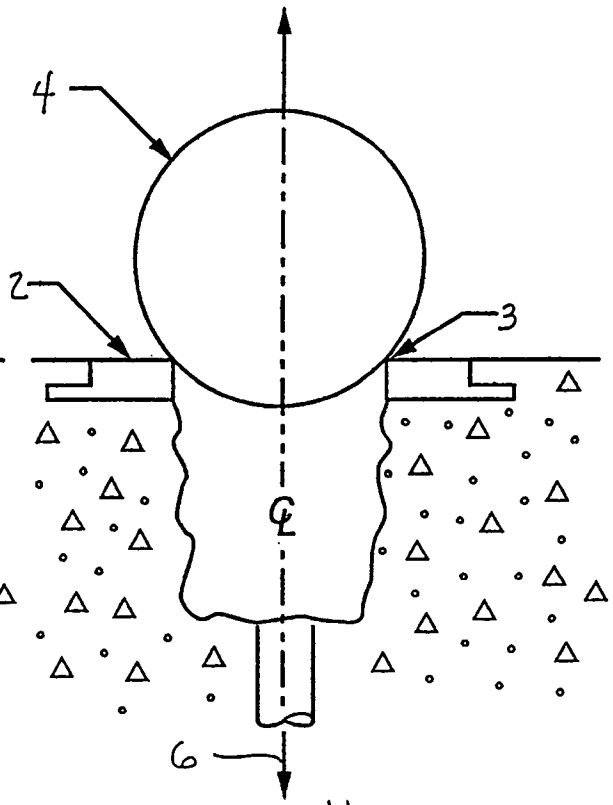
Fig. 1b Prior art
FIG. 1*b* is a cross-sectional view of a sphere sealing a mud frame without an anti-evisceration ring of this invention.
Figure 1A:
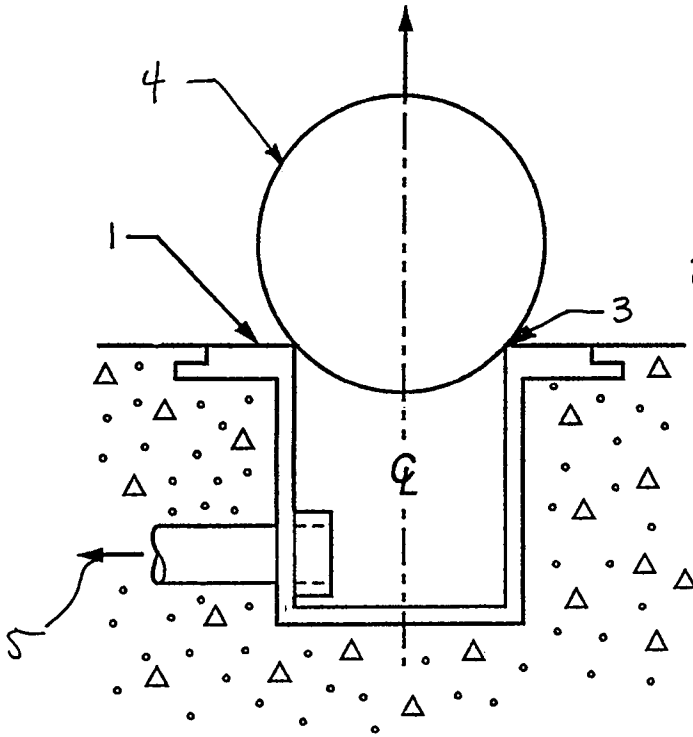
Fig. 1a Prior art
FIG. 1*a* is a cross-sectional view of a sphere sealing a cylindrical sump without an anti-evisceration ring of this invention.
Figure 2A:
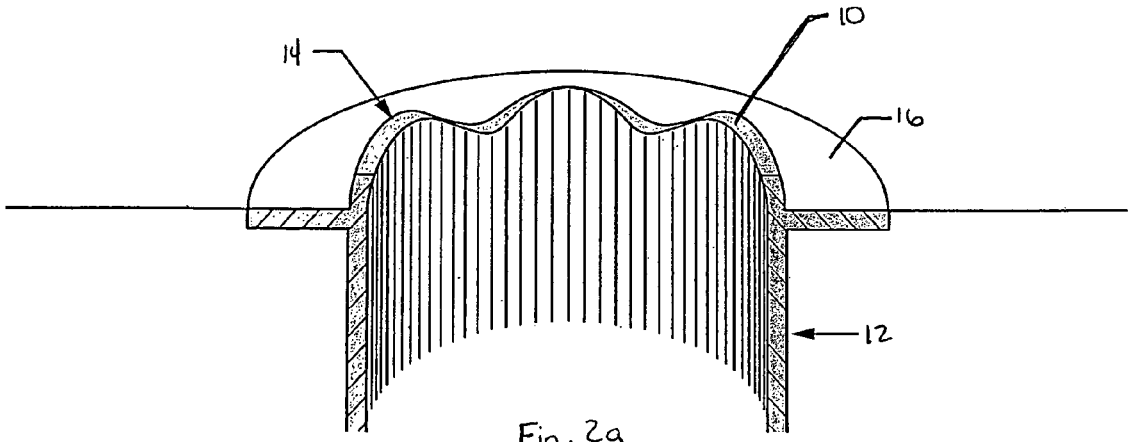
FIG. 2*a* is a cross-sectional view of an anti-evisceration ring according to an embodiment of this invention.
Figure 2B:
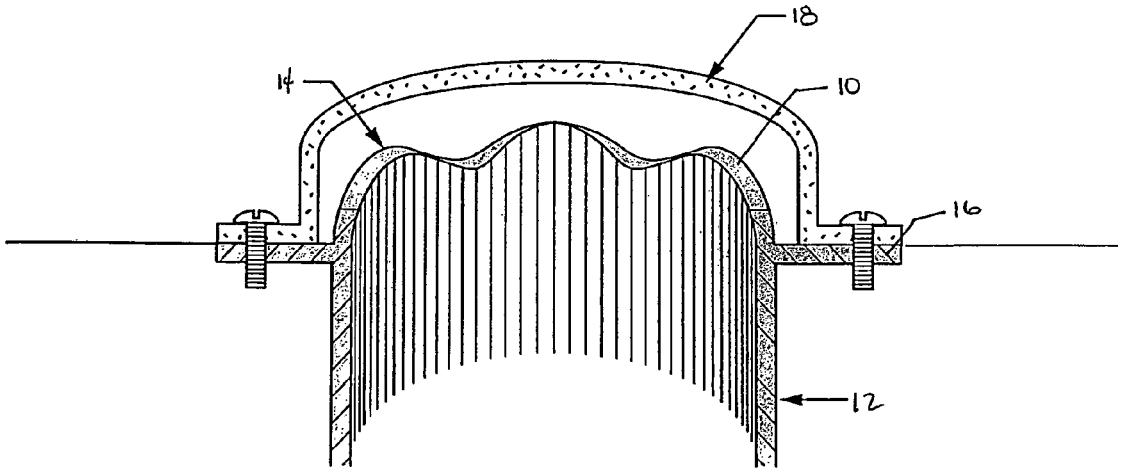
FIG. 2*b* is a cross-sectional view of the anti-evisceration ring of FIG. 2*a* with a pool drain cover.

FIG. 2*a* shows an embodiment of an anti-evisceration ring 10 of this invention that is integrally formed with a cylindrical sump hole 12. The anti-evisceration ring 10 of this embodiment includes a scalloped periphery 14 and a flange 16 extending from an edge of the anti-evisceration ring 10. The scalloped periphery 14 prevents the sump opening 12 from being completely sealed against water or gas flow by a body part, such as a back or buttock, when a cover is removed thereby preventing a formation of a vacuum. FIG. 2*b* shows the anti-evisceration ring 10 of FIG. 2*a* with a cover 18 positioned over the sump opening 12 a connected with a threaded connection.

Figure 3A:
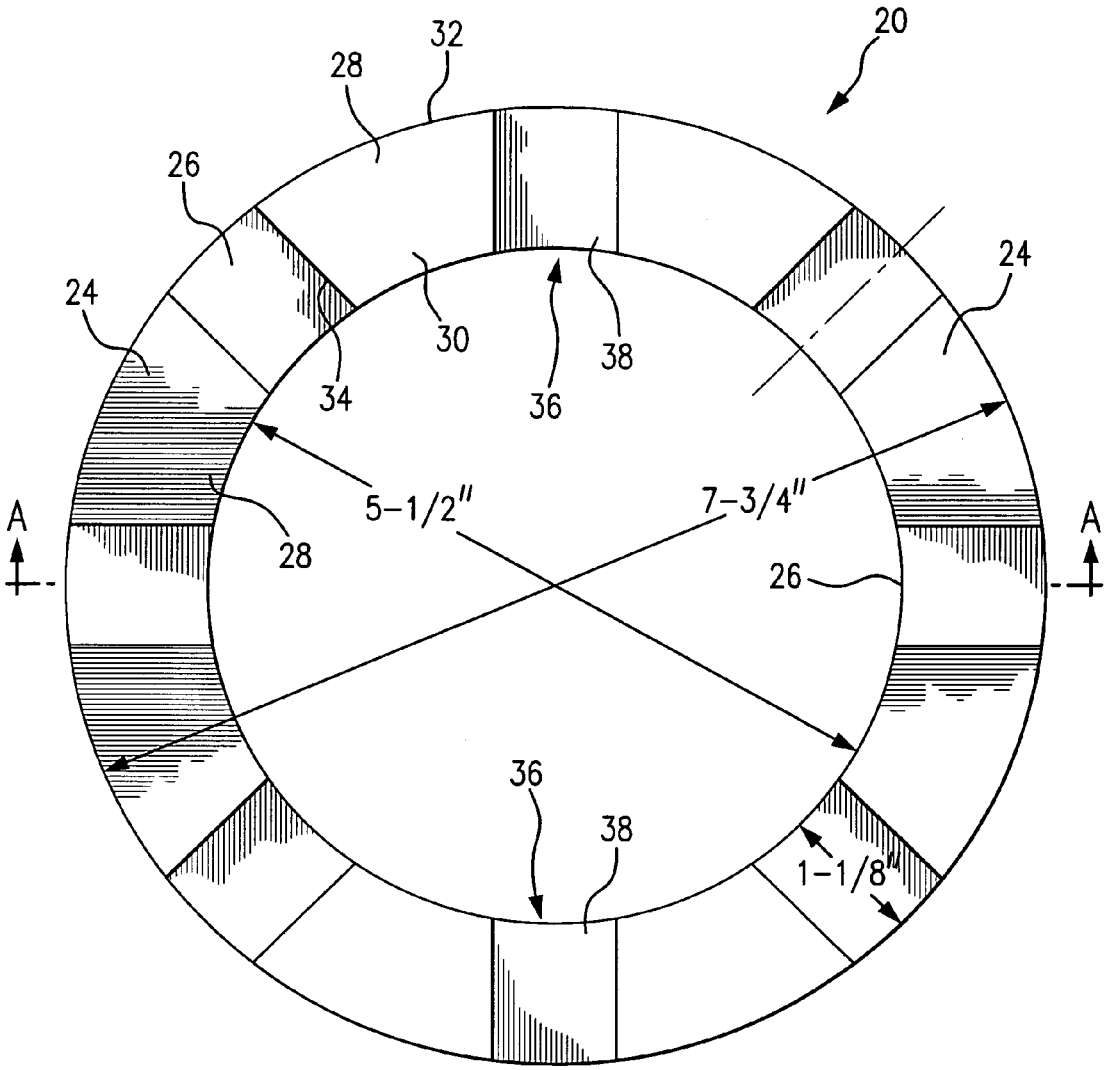
FIG. 3*a* is a top view of the anti-evisceration ring according to another embodiment of this invention.
Figure 3B:
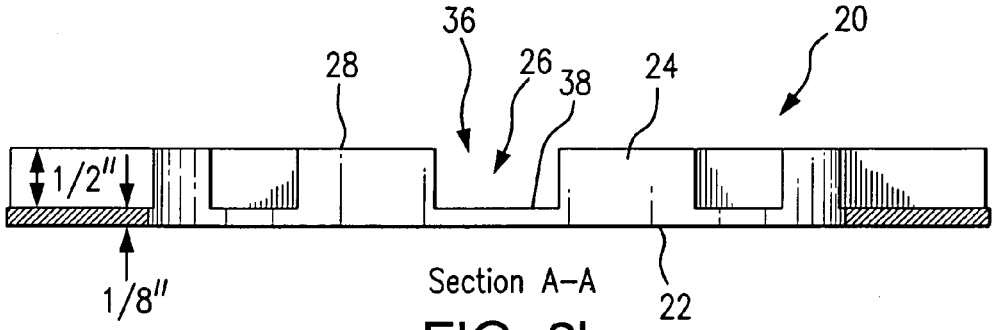
FIG. 3*b* is a side view of the anti-evisceration ring of FIG. 3*a*.

FIGS. 3*a* & 3*b* show a top and side view of a preferred embodiment of the anti-evisceration ring 20 of this invention. The anti-evisceration ring 20 of this embodiment is not integrally formed with a sump and can be retrofit to a sump opening having a flat edge with a permanent connection. As shown in FIG. 3*a*, the anti-evisceration ring 20 comprises an annular shape with an outer diameter of 7¾" and an inner diameter of 5½" and a thickness of ⅝". However the anti-evisceration ring 20 may not comprise this size and shape and may comprise any size shape necessary to correspond to a shape of the sump opening.

The anti-evisceration ring 20 of FIGS. 3*a* & 3*b* further comprises a base 22 with a plurality of merlons 24 extending from the base 22 and a plurality of crenels 26 in a castellation pattern. In this embodiment, the anti-evisceration ring 20 includes eight merlons 24 and eight crenels 24, however, the anti-evisceration ring is not limited eight merlons 24 and crenels 24 and may include any number of merlons 22 ranging from two to twenty or more.

In the embodiment of FIGS. 3*a* & 3*b*, each of the merlons 24 includes an upper merlon surface 28, an inner merlon surface 30 and an outer merlon surface 32 and a pair of side merlon surfaces 34. In this embodiment, the upper merlon surface 28 is parallel to a plane of the base and the inner and outer surfaces 30, 32 match a curvature of the base 22. The side edges 34 are parallel to a centerline radius of the corresponding crenel 26. The surfaces 28, 30, 32, 34 of the merlon 22 form a cube-like shape with two curved sides. However, the merlons 24 need not comprise this cube-like shape and may comprise any shape that prevents the formation of a seal with a body part at the sump opening, including, but not limited to, a domed, a pyramid, and a cylindrical shape. In the embodiment of FIGS. 3*a* & 3*b*, each of the inner surface 30, the outer surface 32 and the side surfaces 34 of the merlon 24 are perpendicular to the plane of the base surface. Alternatively, each of these surfaces 30, 32, 34 may not be perpendicular and may be cantilevered over the sides of the base 22 or recessed from the sides of the base 22.

In the embodiment of FIGS. 3*a* & 3*b*, each of the plurality of crenels 26 comprises an open groove 36 that is defined on two side by the side merlon surfaces 34 and open on the other two sides. Each of the crenels 26 is further defined by a lower crenel surface 38 at a bottom edge. In the embodiment of FIGS. 3*a* & 3*b*, the lower crenel surface 38 is parallel to a plane of the surface of the base 22, however, the lower crenel surface 38 may alternatively be inclined relative to the plane of the surface of the base 22.

Figure 4A:
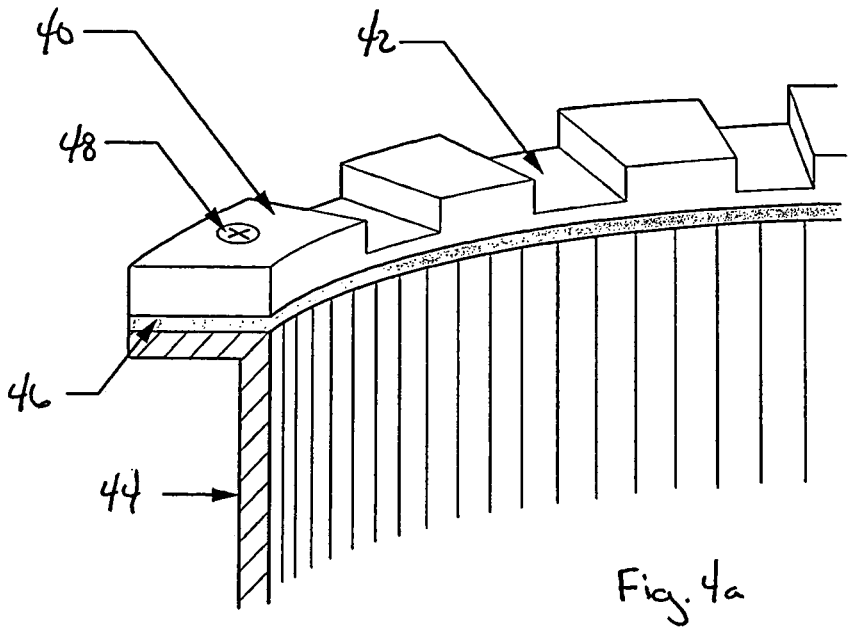
FIG. 4*a* is a partial cross-sectional view of the anti-evisceration ring according to another embodiment of this invention.
Figure 4B:
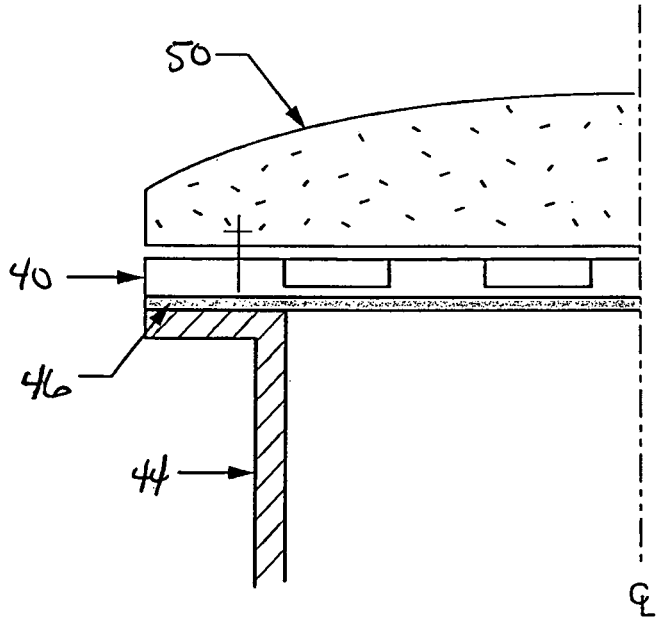
FIG. 4*b* is a partial cross-sectional side view of the anti-evisceration ring of FIG. 4*a* with a cover.
Figure 4C:
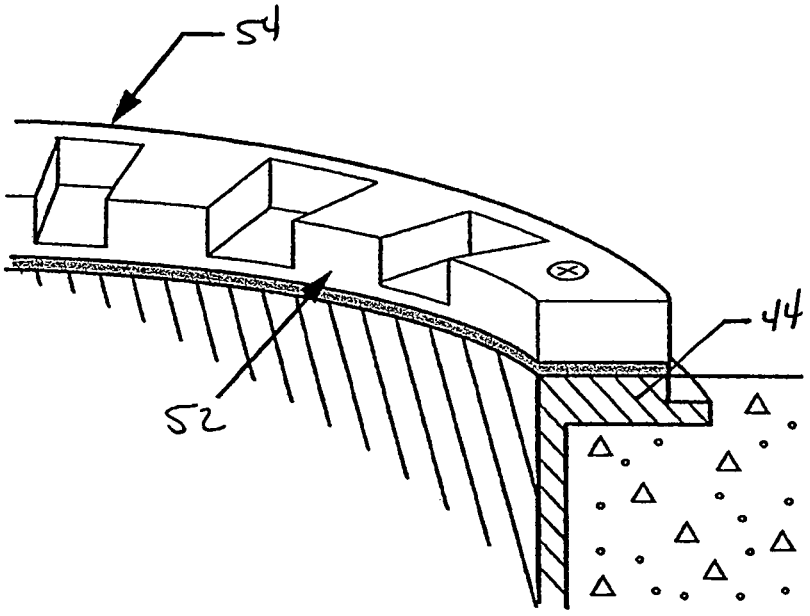
FIG. 4*c* is a partial cross-sectional view of the anti-evisceration ring according to another embodiment of this invention.

FIG. 4*a* shows another embodiment of the anti-evisceration ring 40 of this invention with an open groove castellation pattern 42 mounted to a cylindrical sump 44. In this embodiment, the anti-evisceration ring 40 is permanently mounted to the cylindrical sump 44 with an adhesive connection 46 and a threaded connector 48. The permanent connection is generally preferred so that the anti-evisceration ring 40 is always connected to the cylindrical sump 44 opening to prevent injury to a swimmer. In an alternative embodiment, the anti-evisceration ring 40 may be attached with a removable connection. FIG. 4*b* show the anti-evisceration ring 40 with a removable pool sump cover 50 attached to it. In order to comply with the American National Standard for Suction Fittings for Use in Swimming Pools, Wading Pools, Spas and Hot Tubs, ANSI/APSP-16 2011, Sec. 2.1.4[4], the combined height of the cover 50 and the anti-evisceration ring 40 must not exceed 2 inches. FIG. 4*c* shows another embodiment of the anti-evisceration ring 52 of this invention with a closed groove castellation pattern 54 and mounted to a cylindrical sump 44.

Figure 5A:
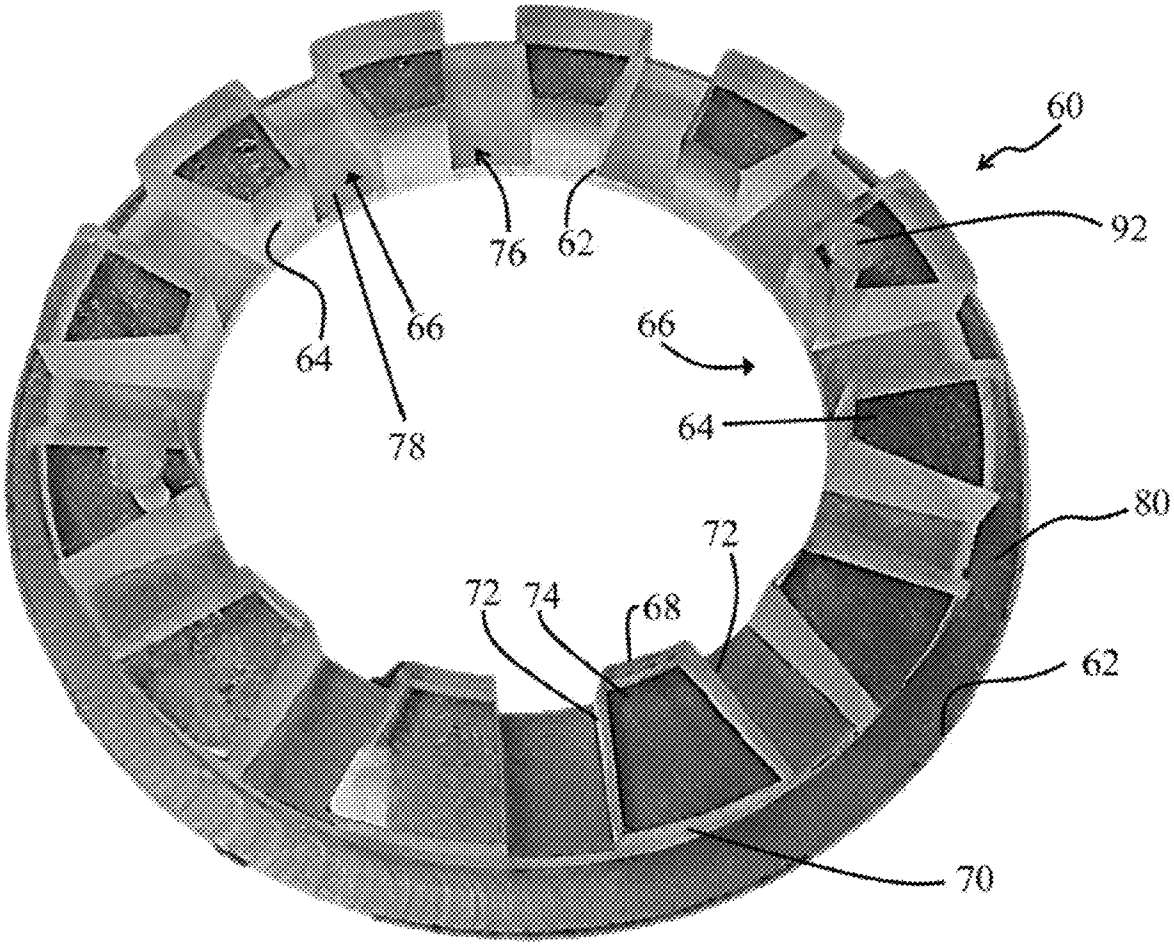
FIG. 5*a* is a perspective view of the anti-evisceration ring according to another embodiment of this invention.

FIG. 5*a* shows another preferred embodiment of the anti-evisceration ring 60 of this invention. In this embodiment, the anti-evisceration ring 60 includes a base 62 with a plurality of merlons 64 extending from a base surface and a plurality of crenels 66, each crenel 66 positioned between a pair of merlons 64 in a castellated pattern. In this embodiment, each of the plurality of the merlons 64 comprise a wedge shape with a curved inner merlon surface 68, a curved outer merlon surface 70 and a pair of side merlon surfaces 72 that define an edge of a crenel 66. Each merlon 64 rises to an upper merlon surface 74 that is parallel to a plane of a bottom surface of the base 62.

In this embodiment, the crenel 66 comprises an open groove 76 that is defined on each side by the side merlon surface 72 and at a lower edge by a lower crenel surface 78. In this embodiment, the lower crenel surface 78 includes a slope to the plane of the bottom surface of the base 62.

The anti-evisceration ring 60 of this embodiment further includes a flange 80 extending from the base 62. As shown in FIGS. 5*b*-5*e*, the flange 80 provides a lip that is trapped by poured concrete 82 to securely attach the anti-evisceration ring 60 to a sump or a mud ring. Additionally, when the anti-evisceration ring 60 is attached to a sump or a mud ring with an adhesive, the flange 80 provides additional surface area for the adhesive connection.

Figure 5B:
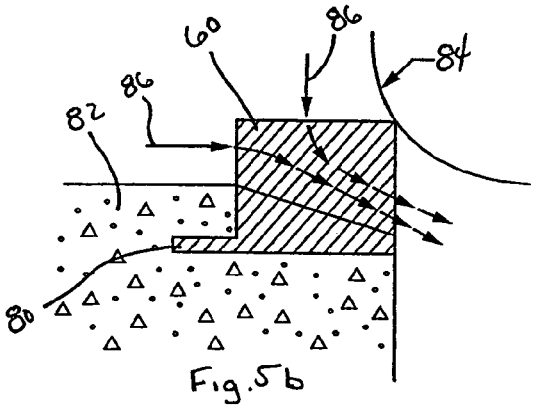
FIG. 5*b* is a partial cross-sectional view of the anti-evisceration ring of FIG. 5*a* with a frame protruding from a surface of a pool.
Figure 5C:
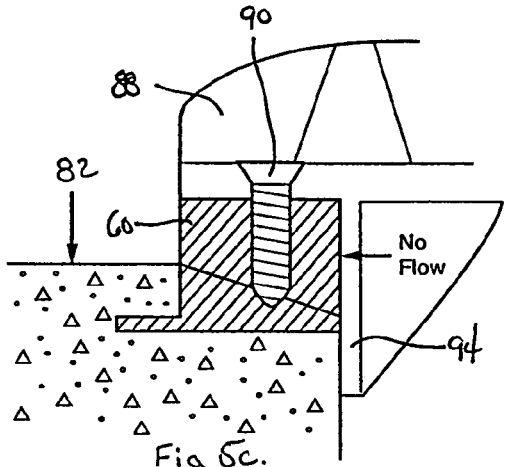
FIG. 5*c* is a partial cross-sectional view of the anti-evisceration ring of FIG. 5*a* with the frame protruding from the surface of the pool and an anti-hair snare cover.
Figure 5D:
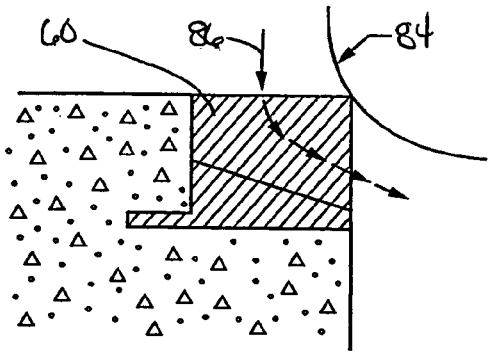
FIG. 5*d* is a partial cross-sectional view of the anti-evisceration ring of FIG. 5*a* with the frame flush with the surface of the pool.
Figure 5E:
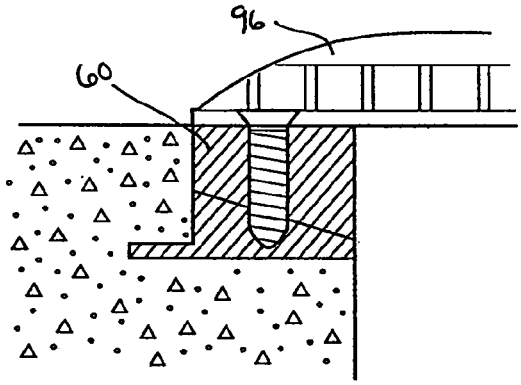
FIG. 5*e* is a partial cross-sectional view of the anti-evisceration ring of FIG. 5*a* with the frame flush with the surface of the pool and a conventional cover.

The anti-evisceration ring 60 of this embodiment can be mounted to a cylindrical sump in at least two ways, protruding from a surface of a pool and flush with a surface of the pool. FIG. 5*b* shows the anti-evisceration ring 60 protruding from the surface of a pool without a cover and FIG. 5*c* shows the anti-evisceration ring 60 protruding from the surface of the pool with an anti-hair snag cover 88. As shown in FIG. 5*b*, a body part 84 cannot form a seal around the sump opening when the cover 88 is removed because a water flow 86 passes through the crenel and around the body part 84 preventing the formation of a vacuum. In FIG. 5*c*, the anti-hair snare cover 88 is attached with a fastener 90 and a receiver 92 in the anti-evisceration ring 60. In this embodiment, the anti-hair snare cover 88 includes a shield 94 extending downward that blocks the flow of water through the crenel 66 and the entrapment of hair. FIG. 5*d* shows the anti-evisceration ring 60 flush with the surface of the pool without a cover and FIG. 5*e* shows the anti-evisceration ring 60 flush with the surface of the pool with a conventional cover 96. As shown in FIG. 5*d*, the body part 84 cannot form a seal around the sump opening when the cover 96 is removed because the water flow 86 passes through the crenel and around the body part 84 preventing the formation of a vacuum.

Figure 6:
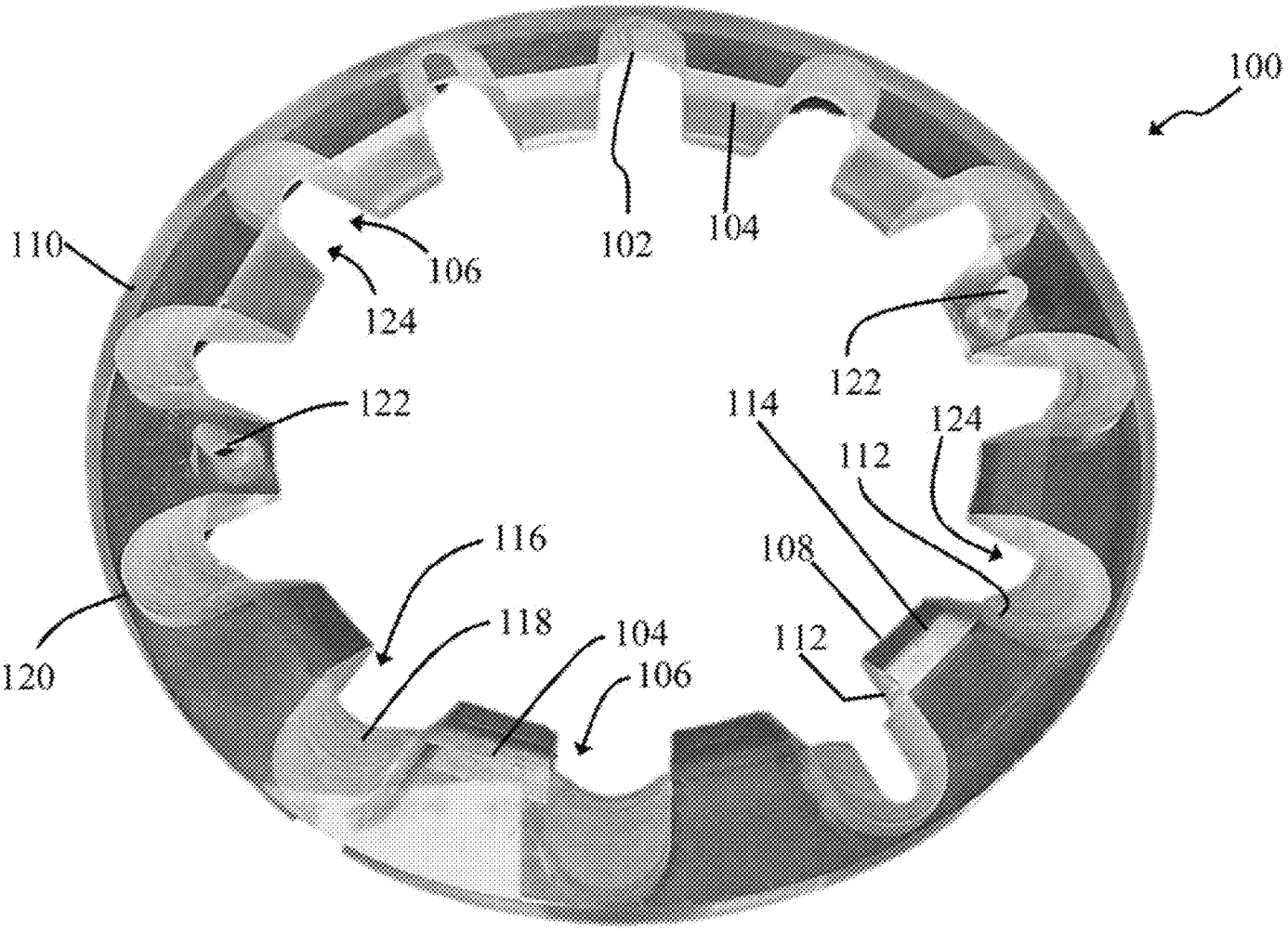
FIG. 6 is a perspective view of the anti-evisceration ring according to another embodiment of this invention.

FIG. 6 shows another preferred embodiment of the anti-evisceration ring 100 of this invention. In this embodiment, the anti-evisceration ring 100 includes a base 102 with a plurality of merlons 104 extending from the base 102 and a plurality of crenels 106 positioned between each pair of merlons 104 in a castellated pattern. Each merlon 104 comprises a wedge shape with a curved inner merlon surface 108 cantilevered from the base 102, a curved outer merlon surface 110 that extends vertically from the base 102 and a pair of side merlon surfaces 112 that define an edge of a crenel 106. Each merlon 104 rises to an upper merlon surface 114 that is parallel to a plane of a bottom surface of the base 102. At least one of the merlons 104 preferably includes a receiver 122 for attaching a cover, not shown, to the anti-evisceration ring 100.

In this embodiment, the crenel 106 comprises a closed groove 116 that is defined on each side by the side merlon surface 112, at a lower edge by a lower crenel surface 118 and at an outer edge by a rear wall 120. In this embodiment, the lower crenel surface 118 is parallel to the plane of the bottom surface of the base 102. In this embodiment, each of the lower crenel surfaces include a curved indentation at an inner portion of the base 102 that mirrors the curved shape of the rear wall 120. At least one of the lower crenel surfaces 118 preferably includes a slot 124 for attaching the anti-evisceration ring 100 to a sump or a mud ring.

Thus, the invention provides a device that can be retrofit to a sump or frame opening to prevent injuries due to missing or broken pool frame drain covers.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. An anti-evisceration ring comprising:

a base including a base surface mountable to a sump or a frame;

a plurality of merlons extending from the base surface to an upper merlon surface;

a plurality of crenels, each crenel is positioned between a pair of merlons and includes a lower crenel surface;

wherein the plurality of merlons and crenels form a non-planar edge; and a cover attachable to the anti-evisceration ring, wherein the cover includes a shield preventing a flow through the plurality of crenels when attached to the anti-evisceration ring.

2. The anti-evisceration ring of claim 1, wherein the base comprises an annular shape.

3. The anti-evisceration ring of claim 1 wherein each of the lower crenel surfaces is inclined relative to the base surface.

4. The anti-evisceration ring of claim 1 further comprising:

a flange extending from a bottom edge of the anti-evisceration ring.

5. The anti-evisceration ring of claim 1 wherein each of the plurality of crenels comprises an open groove.

6. The anti-evisceration ring of claim 1, wherein a height of the cover and the anti-evisceration ring is equal to or less than 2 inches.

7. The anti-evisceration ring of claim 1 wherein the plurality of merlons ranges from 8 to 16 merlons.

8. An anti-evisceration ring comprising:

a base surface mountable to a cylindrical sump or frame;

a merlon extending from the base surface to an upper merlon surface;

a crenel positioned adjacent to the merlon, the crenel including a lower crenel surface, the lower crenel surface spaced from the base surface and lower in height to the upper merlon surface; and a cover attachable to the anti-evisceration ring, wherein the cover includes a cooperative element preventing flow through the crenel when attached to the anti-evisceration ring.

9. The anti-evisceration ring of claim 8, wherein the base surface comprises an annular shape.

10. The anti-evisceration ring of claim 8 wherein the lower crenel surface is inclined relative to the base surface.

11. The anti-evisceration ring of claim 8 wherein the lower crenel surface comprises a plane that is parallel to the base surface.

12. The anti-evisceration ring of claim 8 wherein each of the plurality of merlons comprises a cantilevered edge.

13. The anti-evisceration ring of claim 8 wherein the crenel comprises an open groove.

14. The anti-evisceration ring of claim 8, wherein a height of the drain cover and the anti-evisceration ring is equal to or less than 2 inches.

15. An anti-evisceration ring comprising:

a base surface having an annular shape with a plurality of indentations on an inner edge, the base surface mountable to a cylindrical sump or frame;

an outer edge extending from the base surface to an upper height;

a plurality of merlons extending from the base surface and the outer edge, each of the plurality of merlons including a vertical merlon surface perpendicular to a plane of the base surface, a cantilevered merlon surface sloped relative to the plane of the base surface and an upper merlon surface parallel to the plane of the base surface;

a plurality of crenels, each of the plurality of crenels positioned between a respective pair of merlons, each of the plurality of the crenels defined by the outer edge and a lower crenel surface, the lower crenel surface spaced from the base surface and lower in height relative to the upper merlon surface; and a cover attachable to the anti-evisceration ring, wherein the cover includes a shield to prevent flow through the plurality of crenels when attached to the anti-evisceration ring.

16. The anti-evisceration ring of claim 15, wherein a height of the drain cover and the anti-evisceration ring is equal to or less than 2 inches.

17. The anti-evisceration ring of claim 15 further comprising:

a flange extending from a bottom edge of the anti-evisceration ring.

18. The anti-evisceration ring of claim 15 wherein the plurality of merlons ranges from 8 to 16 merlons.

19. The anti-evisceration ring of claim 1 wherein the shield comprises a downward projecting element to block the plurality of crenels.

* * * * *